United States Patent [19]

Chateau et al.

[11] 4,153,101

[45] May 8, 1979

[54] NOZZLE FOR FEEDING LIQUID METAL TO A CONTINUOUS PLATE CASTING MACHINE

[75] Inventors: Jean-Marie Chateau, Seyssinet; Marc Tavernier; Paul Descous, both of Coublevie, all of France

[73] Assignee: Societe de Conditionnements en Aluminium Scal, Paris, France

[21] Appl. No.: 850,474

[22] Filed: Nov. 11, 1977

[30] Foreign Application Priority Data

Jul. 27, 1977 [FR] France ..... 77 23845

[51] Int. Cl.[2] ..... B22D 11/06; B22D 11/10

[52] U.S. Cl. ..... 164/428; 164/437

[58] Field of Search ..... 164/87, 428, 434, 437, 164/440

[56] References Cited

U.S. PATENT DOCUMENTS 2,790,216 4/1957 Hunter ..... 164/428 X 3,405,757 10/1968 Harvey et al. ..... 164/428 X

*Primary Examiner*—Robert Louis Spruill

*Assistant Examiner*—J. Reed Batten, Jr.

*Attorney, Agent, or Firm*—McDougall, Hersh & Scott

[57] ABSTRACT

The invention is directed to a nozzle for feeding liquid metal to a moving mold of a continuous sheet casting machine, such as continuous casting between cylindrical rolls rotating about a horizontal axis. The nozzle is characterized by cheeks the inner side walls of which extend beyond the orifice initially by a straight element which can be composed of several parts then by a portion that is tapered to diverge from the nozzle axis at an angle of 5° to 15°. These cheeks may be strengthened in order to resist the strains caused by the solidified metal, and they may be provided with cooling or heating means. They are mounted to extend either into the area between the cylindrical rolls or to terminate outside their rolling area. The nozzle, which may be used in all kinds of continuous casting between cylindrical rolls has particular utility with continuous casting machines of high capacity for obtaining sheets or plates free of edge defects with light metals, such as aluminum and its alloys, or heavy metals, such as tin, lead, zinc, copper, and their alloys.

8 Claims, 9 Drawing Figures

NOZZLE FOR FEEDING LIQUID METAL TO A CONTINUOUS PLATE CASTING MACHINE

The invention relates to a device for feeding liquid metal to a mobile plate or strip forming a continuous mold in a casting machine of the type wherein the molten metal is cast between cylindrical rolls mounted for rotational movement on horizontal axes.

Means for continuously producing articles of elongated shape, particularly plates having a thickness of several millimeters by continuous casting liquid metal, are well known to the skilled in the art. Such process is described in the French Pat. No. 1,198,006 assigned to Compagnie Pechiney, and its additions Certificate No. 74,839.

The means generally comprise a feed tank supplied with liquid metal from a melting furnace and which is provided with a neck and a float, for maintaining the metal at constant level.

The tank is provided with one or more injectors generally referred to as nozzles, having a flat configuration, the function of which is to regularly distribute the liquid metal according to the desired width of the band (strip or plate).

The outlet end portion of the nozzle is disposed at a distance which varies with the casting parameters, between the spaced pair of parallel cylindrical rolls. The water-cooled cylindrical rolls are rotated about their axes in opposite directions. Due to their rotation, the molten metal issuing from the nozzle, and having filled the space between the cooled cylindrical rolls, solidifies and is conveyed in the form of a band to between the cylindrical rolls where it is subjected to certain pressure due to the curvature of the cylinders. As the band goes through the plane formed between the axis of the cylinders, it is given its final form and can be wound on a spool.

This invention relates primarily to an injector or nozzle, the function of which is to regularly distribute the liquid metal over a given width. Basically, it has the configuration of a hollow parallel pipe of small height, with the length perpendicular to the flow direction of the metal.

In general, it comprises an upper plate and a lower plate, the outer walls of which are initially plan and parallel to the casting plane on the side of the feed tank, and then they are concavely curved inwardly in order to be received in the space between the cylindrical rolls.

The inner walls are plane and parallel to the cast plane on their entire surface and are maintained in separated relation from each other by ribs with a view towards defining a cavity through which the metal flows. The lower and upper plates are joined one to the other by two members called cheeks which abut the side walls, being parallel to the flow axis, to provide a liquid tight assembly.

The plates and the cheeks, at the outlet of the nozzle, define a rectangular section, called an orifice, through which the liquid metal can issue towards the cylindrical rolls. The cheeks, such as described in the addition patent No. 74,839, have the special feature of extending beyond the orifice so that their ends come in contact with the cylinders.

The so-designed nozzles are suitable for machines where the speed of casting, that is, the production capacity, for aluminium is 1 ton of metal per hour, per meter of the band width, but if it is desired to increase the casting speed, serious difficulties are encountered.

Tears are found on the vertical sides or at the edges of the cast band with a deterioration of the walls of the cheeks. The flow of metal imparts a sinuous appearance on the edge. In both cases, it is necessary to cut off the two edges of the produced band. This is an additional step, the cost of which when added to that of recycling said metal undesirably increases the production cost of the band.

To overcome these difficulties, the applicants have provided a type of nozzle which substantially increases the production capacity of current casting machines while at the same time avoiding the edge defects described.

This nozzle is characterized in that its cheeks extend forwardly beyond the orifice in such a way that its inner side walls successively define an initial straight portion parallel to the axis of the nozzle, the length of which is between the thickness of the cast band and depth of liquid metal pool, and then a portion which diverges from the axis of the nozzle and forming therewith an angle from 5° to 15° and which is dimensioned to have a length such that its end reaches the plane between the axes of the cylinders.

Thus, the two cheeks extend beyond the orifice of the nozzle according to a predetermined length and profile at least in respect of the wall of the cheek engaged by the metal. As to the other walls, their length approaches that of the inner wall while their profile, which can have any form for the outer side wall but the upper and lower walls will correspond with the contour of the cylinders.

Thus, the two cheeks are characterized by a side wall extended, first, by a straight portion parallel to the axis of the nozzle, i.e. they extend beyond the orifice of the inner side wall of the nozzle without interruption. This extension is fixed at least at the thickness of the cast band, and its maximum will be the depth of the liquid metal pool of the band.

It must be pointed out here that the solidification of the metal starts as soon as it leaves the nozzle, i.e. when the metal escapes at the orifice thereof, but it is completed a certain distance from the orifice, called the depth of the liquid metal pool, and, in any event, before the plane is reached between the axes of the cylinders, called "the outlet plane". The closer the complete solidification is produced to the orifice, the slower the speed of the casting. Consequently, the maximum length of the extension of the cheeks parallel to the axis thereof will depend on the speed of casting. It will also depend on the distance between the orifice of the nozzle and the "outlet plane", which distance is called the arc of contact, because it represents the length along which the metal and the cylinders are in contact and where a transfer of calories takes place. Finally, the maximum of said extension will also depend on the thickness of the cast band and the difference between the temperature of the cast metal and the temperature of solidification.

This value cannot be determined a priori; it is experimentally determined according to the criteria of the machine run by known methods, such, for example, as by introducing rods of 1 mm diameter into the nozzle and measuring the distance at which the end of said rods meets the solidified metal.

Beyond the straight portion of a length between the thickness of the band and the depth of the liquid metal pool, the cheeks are also characterized by the presence of a straight portion forming an angle from 5° to 15° with the preceding portion and diverging from the axis of the cast flow in the nozzle. Thus, at this location, the cheeks have an inner side wall which is an extension of the upstream wall (when the flow direction of the metal is considered), through the intermediary of continuation means embodied in a vertical ridge around which the wall turns at an angle between 5° and 15° so as to diverge from the axis of the nozzle and thus to form a downstream directed spread or "taper" being of such length that the end of the cheeks is situated in the "outlet plane".

A special feature of the invention consists in providing each of the outer side walls of the cheeks with shoulder called countercheeks. When starting the machine, there is a transitory step during which the depth of the liquid metal pool remains below the thickness of the cast band.

In this situation, premature solidification of the metal takes place and the ends of the cheeks are then subjected to considerable side strains. If the used materials have weak mechanical characteristics, possible deformation and even a rupture of the nozzle can take place.

For this reason, reinforcing shoulders are provided for the rigid members, consisting of one or two elements applied to the outer side walls of the cheeks and attached on the side of the feed vat, and, by mounting means including screws to the frame of the machine and, on the opposite side, by a corner piece, one side of which is attached to the outer side wall of the countercheek and the other to the wall of the countercheek facing the cylinders.

Another feature of this invention makes is possible to eliminate lateral strains at the end portions of the cheeks at the beginning of the machine run. This consists in making said portions movable so as to space them from contact with solidified metal during the transitory phase and to return them to their place when the normal steady state is reached. Thus, the extension of the cheeks beyond the orifice consists of a stationary portion integral with the cheek itself and of at least one movable portion constituting a detachable member.

The stationary portion has an inner side wall parallel to the axis of the nozzle and of a length equal to that of the depth of the liquid metal pool at the start of the run. The inner side wall of the movable portion completes the preceding portion, adding to it a length necessary to give as a total a value between the thickness of the band and the depth of the liquid metal pool in a normal run and that of the taper corresponding to the above-described sides.

The mechanism for moving the detachable member is operable by conventional means.

A variation of the invention provides resistance to strains to which the cheeks can be subjected during the adjustment period of the machine. It comprises mechanical means, such as springs on the outer side wall of the cheeks, by which the cheeks are moved away from each other at the moment when an abnormal strain is exerted by the metal and returns the cheeks to their initial position when the strain no longer exists.

It is within the scope of the present invention to use nozzles whose length of orifice corresponds to the length of the work area of the cylinders; in such event, the cheeks are located outside the cylinders so that their straight vertical side wall of the length between the thickness of the band and the depth of the liquid metal pool will rub the side of the cylinders perpendicular to the axis of the latter. This special device makes it possible to cast bands of a maximum width for a given setting of the cylinders and provides the possibility of advancing or retracting the cheeks without being disturbed by the distance between the cylinders. According to this arrangement, the cheeks are provided with means for sliding the cheeks along the outer walls of the plates of the nozzle and thus easily adjusting the length beyond the orifice and rapidly adapting to the change in the casting parameters.

To avoid any occurrence of the machine being put out of order because of heat, the cheeks of the invention are expediently provided with cooling or heating devices and with control devices to prevent defects at the edges of the casting or premature solidifying and ensuring a flexible continuous operation.

The invention will be understood with accompanying Drawings, wherein.

Figure 1:
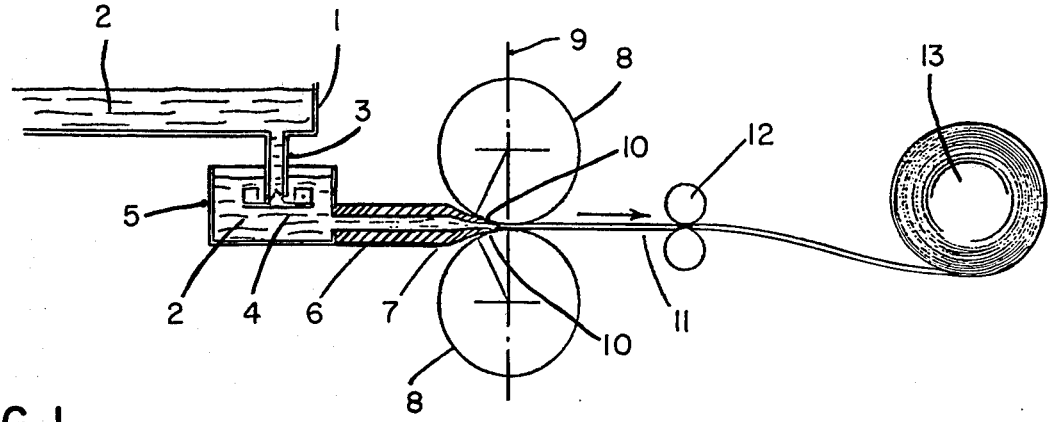
FIG. 1 is a cross sectional view of a continuous casting machine embodying the features of this invention showing the nozzle and its cheeks.

FIG. 1 shows in detail a casting machine comprising a groove 1 containing liquid metal 2 and provided with a tube 3 and a float 4 for maintaining a constant level of the metal in the feed tank 5. The tank 5 communicates with a nozzle 6 which delivers molten metal through the orifice 7 to between two cylinders 8. The metal fills the space between the orifice, the plane of the axis of cylinders 9 called outlet plane, and the arc of contact 10 and, after solidification and rolling, it exists in the form of a band 11 which, through the intermediary of the deflecting rolls 12, is wound on a spool 13.

Figure 2:
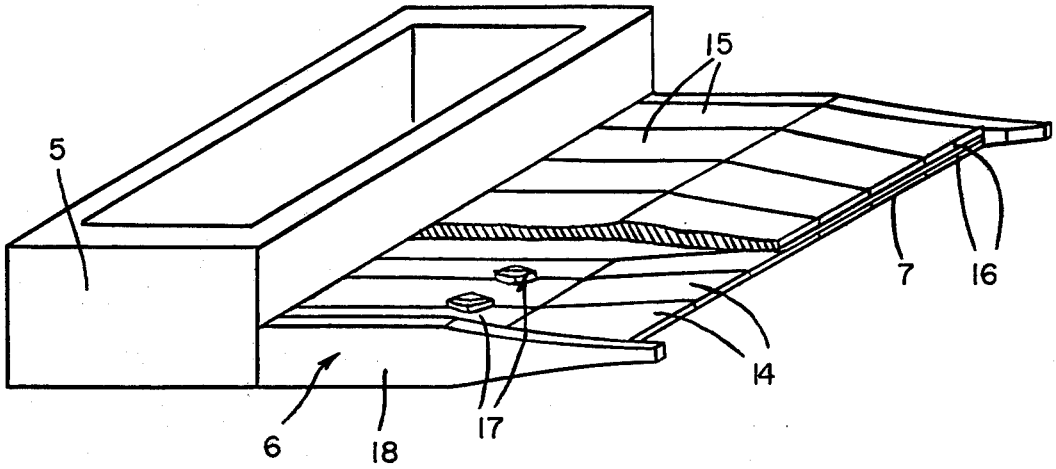
FIG. 2 is a perspective view of the feed tank and the nozzle.

FIG. 2 shows in perspective a feed tank 5 and nozzle 6. The nozzle comprises several parts 16 each having a lower plate 14 and an upper plate 15, separated by cross pieces 17 to define between them a space communicating with the outside via the orifice 7.

Figure 3:
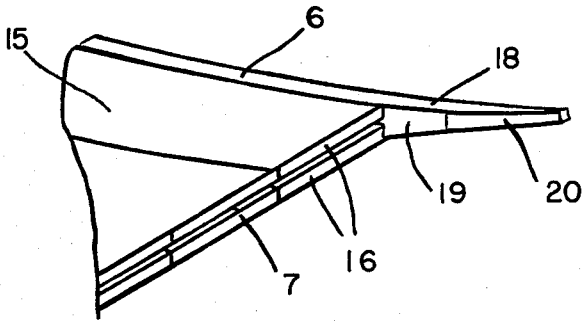
FIG. 3 is a perspective view of a portion of the nozzle.

FIG. 3 is a perspective view of a portion of the nozzle showing the extension 18 of the cheek beyond the orifice; on the inner side wall, there is first a straight portion 19 parallel to the axis of the nozzle, and then a portion 20 diverging from the axis of the nozzle. The curved shape of the portion of the cheek and of the plates engaged between the cylinders should be noted.

Figure 4:
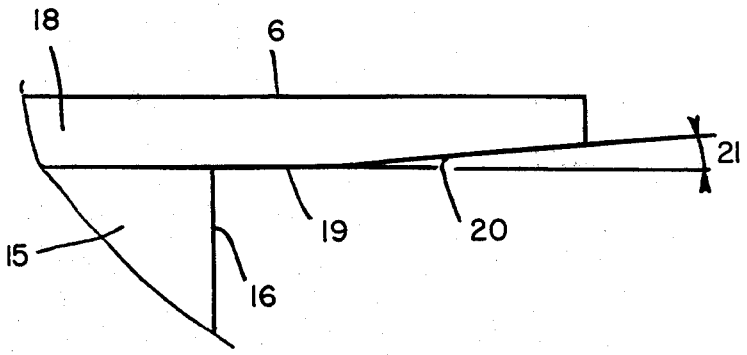
FIG. 4 shows a portion of the nozzle with the cheek.

FIG. 4 is a top plan view of the nozzle in which the inner wall of the cheek forms an angle 21 or divergence formed by the inner side walls 19 and 20.

Figure 5:
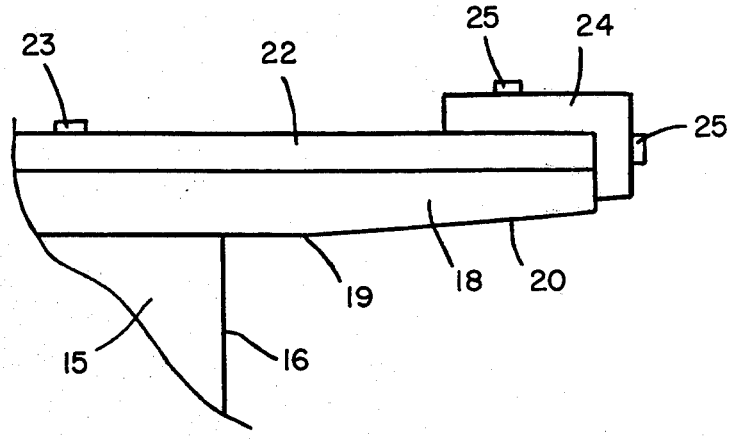
FIG. 5 shows a portion of the nozzle with a countercheek.

FIG. 5 in the same view as before shows a portion of the nozzle reinforced by a countercheek 22 held by a screw 23 along the entire length of the cheek and, at its end, by a corner piece 24 and screws 25.

Figure 6:
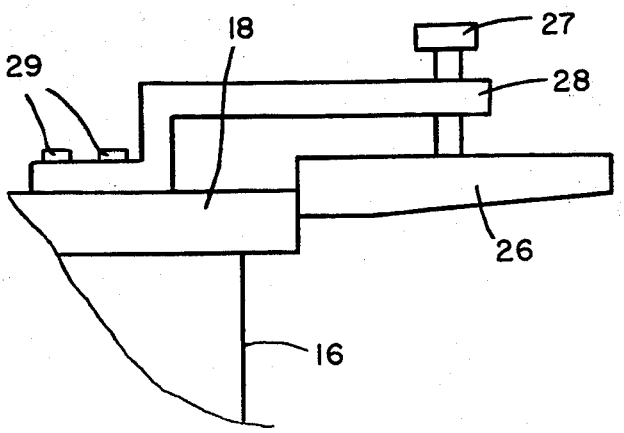
FIG. 6 shows a portion of the nozzle with the removable member of the cheek.

FIG. 6 is the same as the preceding view end shows a cheek and a detachable member 26 fixed by a screw 27 rotatable on a support 28 attached by a screw 29 to the cheek.

Figure 7:
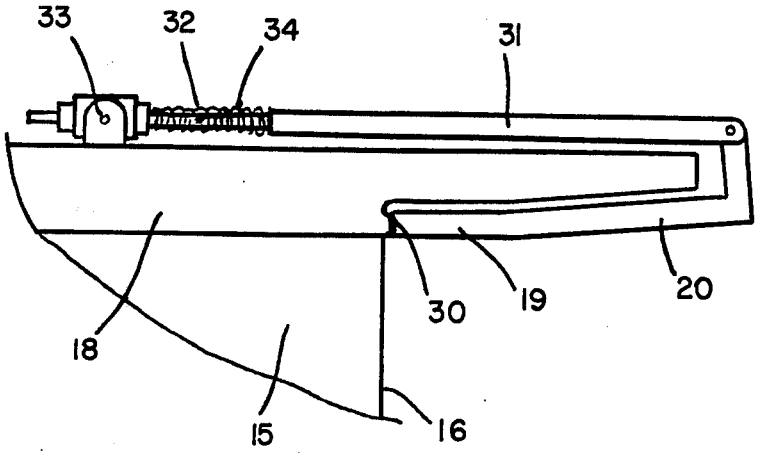
FIG. 7 shows a portion of the nozzle with mechanical means for returning the check to its initial position after displacement in response to strain.

FIG. 7, at the same view, shows a portion of the nozzle having mechanical means by which the cheek ends are moved from each other at the time of strain and for returning it to the initial position when the strain passes. It will be seen that the extended portion of the cheek is adapted to pivot around an axis 30. The movement is communicated to an arm 31 sliding on a shaft 32 fastened to a support 33 and, when force is applied, it compresses a spring 34; when the force disappears said spring relaxes and returns the end of the cheek to its original position.

Figure 8:
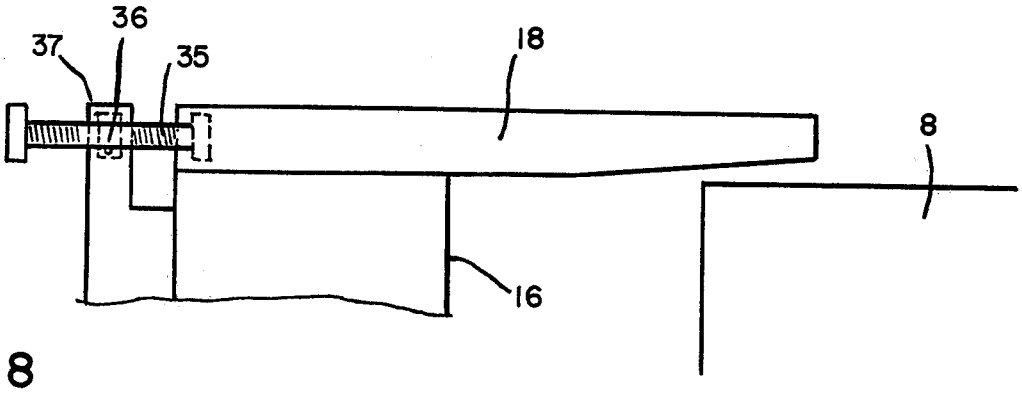
FIG. 8 shows a portion of the nozzle with a sliding cheek.

FIG. 8 shows a sliding cheek in which the longitudinal end, on the side of the feed tank, has an extension in the form of a threaded rod which can freely turn in the body of the cheek without separating therefrom, and which passes inside of a tapped part 36 mounted on the frame of the machine 37. By screwing the rod 35 in or out, the cheek can be moved forward or back relative to cylinders 8.

Figure 9:
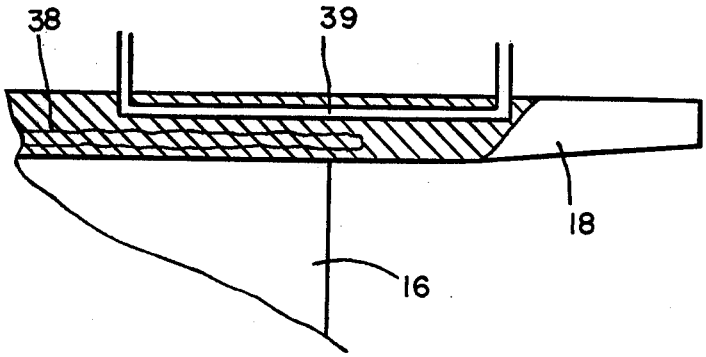
FIG. 9 shows a portion of the nozzle with heating and cooling means.

FIG. 9 shows a cheek incorporating heating members 38 and cooling members 39 which, particularly upon thermal drift of the machine and during the periods of transitory run, compensate the thermal variations of the machine.

The invention is further illustrated by the following examples:

EXAMPLE 1

A casting machine provided with a nozzle following the invention has been fed with aluminium. Several working factors have been applied, which makes it possible to exceed the usual production capacities of one metric ton per hour, per meter of width.

| | | | | | | | | |
|---|---|---|---|---|---|---|---|---|
| Diameter of the cylindrical rolls in millimeters | 540 | 620 | 620 | 620 | 620 | 620 | 960 | 960 |
| Arc of contact in millimeters | 60 | 70 | 55 | 45 | 45 | 45 | 100 | 70 |
| Thickness of the plate in millimeters | 10 | 10 | 10 | 10 | 7 | 5 | 6 | 10 |
| Length of the straight portion (19) in mm | 15 | 35 | 25 | 20 | 7 | 5 | 15 | 30 |
| Angle (21) in degrees | 10 | 10 | 10 | 15 | 10 | 10 | 10 | 10 |
| Productivity (without flowing out from the edges), ton per hour and per meter of width. | 1.4 | 2 | 1.8 | 1.5 | 1.3 | 1.3 | 2.2 | 2.2 |

EXAMPLE 2

The casting machine provided with an identical nozzle has been used for casting lead.

The working factors have been as follows:

| | |
|---|---|
| Diameter of the cylindrical rolls, in millimeters | 220 |
| Arc of contact in millimeters | 75 |
| Thickness of the plate, in millimeters | 2.8 |
| Length of the straight portion (19) in millimeters | 30 |
| Angle (21), in degrees | 10 |

The production capacity can be increased to 7.6 tons per hour and per meter, whereas, in conventional machines, for obtaining a plate free of defects, without flowing out from the edges, the capacity is limited to 4.7 tons per hour and per meter.

The nozzle of this invention is suitable for all kinds of machines for continuous casting between cylindrical rolls, but it is particularly suitable when high production capacities are desired, from light metals, such as aluminium and its alloys or heavy metals such as tin, lead, zinc, copper and their alloys, for obtaining plates without defect on the edges.

We claim:

1. In a machine for the continuous casting of molten metal between a pair of cylindrical rolls mounted for rotational movement about horizontal axes, a nozzle for feeding the molten metal comprising an upper plate and a lower plate joined one to the other by cheeks having an orifice from which the molten metal issues, said cheeks extending forwardly beyond the orifice and the inner side walls of said cheeks defining in succession a straight portion parallel with the axis of the nozzle dimensioned to have a length between the thickness of the cast band and the depth of the liquid metal pool, the depth of the liquid metal pool defined as the distance of the liquid metal from the orifice to a position where the liquid metal has completely solidified, and a portion that diverges from the axis of the nozzle at an angle within the range of 5° to 15° and which extends to the plane between the axes of the cylindrical rolls.

2. A nozzle as claimed on claim 1, in which a countercheek is fixed to the outer side wall of each of the cheeks.

3. A nozzle as claimed in claim 1, in which the extension of the cheeks beyond the orifice include a stationary portion with the cheek itself and at least one movable portion constituting a detachable member allowing to increase or decrease the spaced relation therebetween.

4. A nozzle as claimed in claim 3 which includes means operatively engaging the movable portions of the cheeks for returning the cheeks to their original position.

5. A nozzle as claimed in claim 1 in which a portion of the cheeks is movable in the direction toward and away from each other between normal and extended positions and which includes spring means constantly urging the movable portions of the cheeks toward their normal position.

6. A nozzle as claimed in claim 1 in which the inner side walls of the cheeks in the portion parallel to the nozzle axis are spaced one from the other by an amount slightly greater than the length of the cylindrical members.

7. A nozzle as claimed in claim 6 which includes means mounting the cheeks for movement in a direction parallel to the casting axis.

8. A nozzle as claimed in claim 1 in which the cheeks include heating and cooling means.

* * * * *